US005942095A

United States Patent [19]

Day et al.

[11] Patent Number: 5,942,095

[45] Date of Patent: Aug. 24, 1999

[54] METHOD OF CONTINUOUS PURIFICATION OF LIQUID TONER IN AN ELECTROSTATIC PRINTING SYSTEM

[75] Inventors: Gene F. Day, Hillsborough; Arthur E. Bliss, Sunnyvale, both of Calif.

[73] Assignee: Phoenix Precision Graphics, Inc., Sunnyvale, Calif.

[21] Appl. No.: 08/985,032

[22] Filed: Dec. 4, 1997

Related U.S. Application Data

[62] Division of application No. 08/726,795, Oct. 7, 1996.

[51] Int. Cl.[6] ..... B03C 5/00

[52] U.S. Cl. ..... 204/553; 204/571; 204/649; 204/669; 399/225

[58] Field of Search ..... 204/553, 554, 204/571, 572, 648, 649, 660, 669; 399/225

[56] References Cited

U.S. PATENT DOCUMENTS

| | | | |
|---|---|---|---|
| 3,642,605 | 2/1972 | Chenel et al. | 204/649 |
| 3,817,843 | 6/1974 | Barrett | 205/77 |
| 3,909,383 | 9/1975 | Sato | 210/665 |
| 4,100,068 | 7/1978 | Jordan et al. | 209/127.1 |
| 4,331,525 | 5/1982 | Huba et al. | 210/650 |
| 4,799,452 | 1/1989 | Day | 399/225 |
| 4,895,103 | 1/1990 | Day | 399/225 |
| 4,906,381 | 3/1990 | Barbaro | 210/660 |
| 4,923,581 | 5/1990 | Day | 204/571 |
| 4,987,429 | 1/1991 | Finley et al. | 347/115 |
| 5,173,168 | 12/1992 | van Haastrecht et al. | 205/77 |
| 5,174,879 | 12/1992 | Gadke-Furhmann | 204/265 |
| 5,231,455 | 7/1993 | Day | 399/225 |
| 5,296,137 | 3/1994 | Gershon et al. | 210/253 |
| 5,404,210 | 4/1995 | Day | 399/225 |

*Primary Examiner*—Kathryn Gorgos
*Assistant Examiner*—William T. Leader
*Attorney, Agent, or Firm*—Thomas Schneck; John P. McGuire, Jr.

[57] ABSTRACT

A continuous purification method for removing neutral, as well as ionic, contaminants from liquid toner in an electrostatic printing system is disclosed. This method involves circulating liquid toner from a toner supply tank through a common volume which includes the toning applicator. The liquid toner is introduced to solid and ionic contaminants in the common volume and as the toner is circulated back to the toner supply tank for each toning pass, some contaminants and toner are left in the common volume. Next a wash fluid from a wash fluid supply tank is circulated through the common volume after each toning pass, the wash fluid mixing with the toner and the contaminants. This mixture is then passed through an electrophoretic purifier to remove the contaminants. Then the mixture passes through a porous particulate filter to remove any remaining contaminants before it returns back to the wash fluid supply tank.

7 Claims, 3 Drawing Sheets

METHOD OF CONTINUOUS PURIFICATION OF LIQUID TONER IN AN ELECTROSTATIC PRINTING SYSTEM

CROSS REFERENCE TO RELATED APPLICATION

This is a divisional of patent application Ser. No. 08/726,795; filed Oct. 7, 1996.

TECHNICAL FIELD

The present invention relates to systems and methods for purifying liquids, and more particularly to a method of continuous purification of liquid toners used in electrostatic printing.

BACKGROUND ART

Disposal of spent toners has long been a major problem for users of electrostatic plotters, printers and copiers. Environmental awareness, disposal costs, and strict governmental regulations relating to chemical handling and disposal have threatened the present manner of use of liquid toners. Alternatives that reduce disposal amounts and allow for reuse of some of the materials are clearly needed.

A method already exists, in principle, for eliminating the need for liquid toner disposal. This is described in U.S. Pat. Nos. 4,799,452; 4,895,103 and 4,923,581, all to G. F. Day. In this method, the toner itself is eliminated except for a transitory existence just at the moment of toning. Concentrated "ink" of each color is stored in a small tank and injected into and mixed with a continuous stream of clear dispersant. The resulting toner stream is passed through the toner applicator and then quickly decomposed back into concentrate and dispersant. This is done electrophoretically with a purifier, described in the above-referenced patents. The solid pigment particles are plated out on a rotating drum, then scraped off the drum and re-dispersed by vigorous mixing into the concentrate holding tank. To stop the toning process the injection of the selected concentrate is simply terminated.

It would seem that this recycling concept might provide a liquid toning technology free of disposal problems since a large volume of contaminated or spent toner would never exist. However, the basic cause of disposal is not eliminated. Eventually the contents of the concentrate tanks would have to be discarded due to contamination as would the fluid in the dispersant tank. This is because the contaminants are re-mixed with the dispersant along with the pigment particles and are, therefore, never removed from the system. The quantity of liquid to be thrown away would be smaller, but some disposal problems would remain. The dispersant would have to be discarded when the conductivity level became high enough to interfere with image toning. A much higher level of contamination could be tolerated in the color concentrate tanks because of the dilution upon injection into the dispersant stream, but eventually the concentrate would also need replacement. In addition, the recycling architecture is relatively complex. It requires precise metering and mixing of two fluid streams and high speed separation of the toner into its components as it flows out of its applicator. With the high flows which are characteristic of full-width toner applicators, the separation apparatus must be quite large and, therefore, costly.

In order to electrophoretically separate a toner stream into its components, the fluid is passed between two closely spaced, parallel electrodes while a high voltage is imposed across the gap. All of the fluid must be exposed to the full electric field and this means the flow must normally be confined to the gap region with some kind of fluid seals along the lateral edges of the separation zone. One of the electrodes must also be moving so that the accumulating sludge can be scraped off and sent to the appropriate concentrate tank. The seals which confine the fluid flow within the gap present numerous technical difficulties. They must support the high voltage and this high voltage appears across the exposed surface of the seal which joins the two electrodes. Surface electrical breakdown keeps the applied voltage lower than would otherwise be desired and this, in turn, causes the purifier to be yet larger in order to assure total separation of the solids from the clear fluid. Also, depending on the specific toner formulation, redispersion of the deposited solids layer into the color concentrate tank can be difficult and energy intensive. Thus, the range of toner formulations which can be employed for this purpose is limited.

Commonly assigned U.S. Pat. No. 5,404,210 to Day describes a method of continuously purifying small portions of the liquid toner by using a rotating-drum-type of electrophoretic purifier to keep contamination below the level at which it will interfere with imaging. That method would benefit from a higher level of purification for each pass, however. Rotating-drum-type purifiers are effective at removing solid contaminants such as particles of color pigment, paper debris, and ions from the fluid dispersant. In a typical spent liquid toner, however, neutral molecules which ionize slowly are also present. These neutral molecules are relatively unaffected by a drum-type purifier. After they pass through the drum purifier, they remain in the fluid where their slow and continuing ionization causes an undesirable increase in conductivity that interferes with electrostatic imaging. Thus, the neutral molecules act as a source for new ions. Removal of these "ionizable" molecules is necessary for complete purification of the liquid.

The use of porous particulate, i.e. nonmembranous, filter purifiers to remove contaminants from a liquid is well-known. There must usually be a pretreatment step before the filter purifier is used on liquids having suspended solids, however. See e.g., U.S. Pat. No. 5,296,137. Purification by a filter purifier alone generally shortens the effective life of the filter purifier as solid contaminants can clog the purifier and interfere with the ability of the filter particulates to contact and remove contaminants from the liquid. For example, difficulties arise in the use of a single filter purifier with spent toners. The filter purifier can remove all contaminants including toner solids, paper debris, ions, and ionizable and neutral molecules. The toner particles interfere with the effectiveness of the filter purifier, however, and necessitate replacement of the filter purifier on a regular basis. This short operating life leads to the problem of disposal or recycling of the purifier itself, as well as the cost of supplying new purifiers. Similar limitations are to be expected when purifying any other liquid of a variety of contaminants, particularly when significant amounts of solid contaminants are present.

It is an object of the present invention to reduce disposal amounts of liquids having contaminants and to increase the likelihood of reuse of such materials.

It is another object to provide a method of purifying liquid toner in order to allow an electrostatic printing system to perform with improved image quality and improved image consistency.

It is yet another object to provide a method of purifying liquid toner in an electrostatic printing system so that frequent replacement of materials is unnecessary.

DISCLOSURE OF THE INVENTION

The above objects have been achieved with a method of continuously removing solid and ionic contaminants from liquid toner in an electrostatic printing system. This method utilizes an electrophoretic purifier followed by a porous particulate filter purifier. By using the two purifiers sequentially, the limitations of each is avoided.

In an electrostatic printing system, the liquid toner is circulated from a toner supply tank through an input selector manifold. From there it goes to a toning applicator which contacts the paper or other printing surface. During this process, some contaminants are introduced into the toner. Wash fluid from a wash fluid supply tank is circulated through the input select manifold in the same manner as the color toners. The dirty wash fluid is then passed through the two purifiers, first the electrophoretic purifier, then the porous particulate filter purifier. The purifiers remove the contaminants and the purified wash fluid is returned to the wash fluid supply tank. This process is repeated for each color toning pass in the system.

An advantage of the present invention is the elimination of expensive and wasteful disposal of large volumes of liquid waste such as spent liquid toners.

Another advantage is the thorough purification of such liquids using small and inexpensive purifiers.

A further advantage is the safe, easy use of the method of the present invention.

BEST MODE OF CARRYING OUT THE INVENTION

Figure 1:
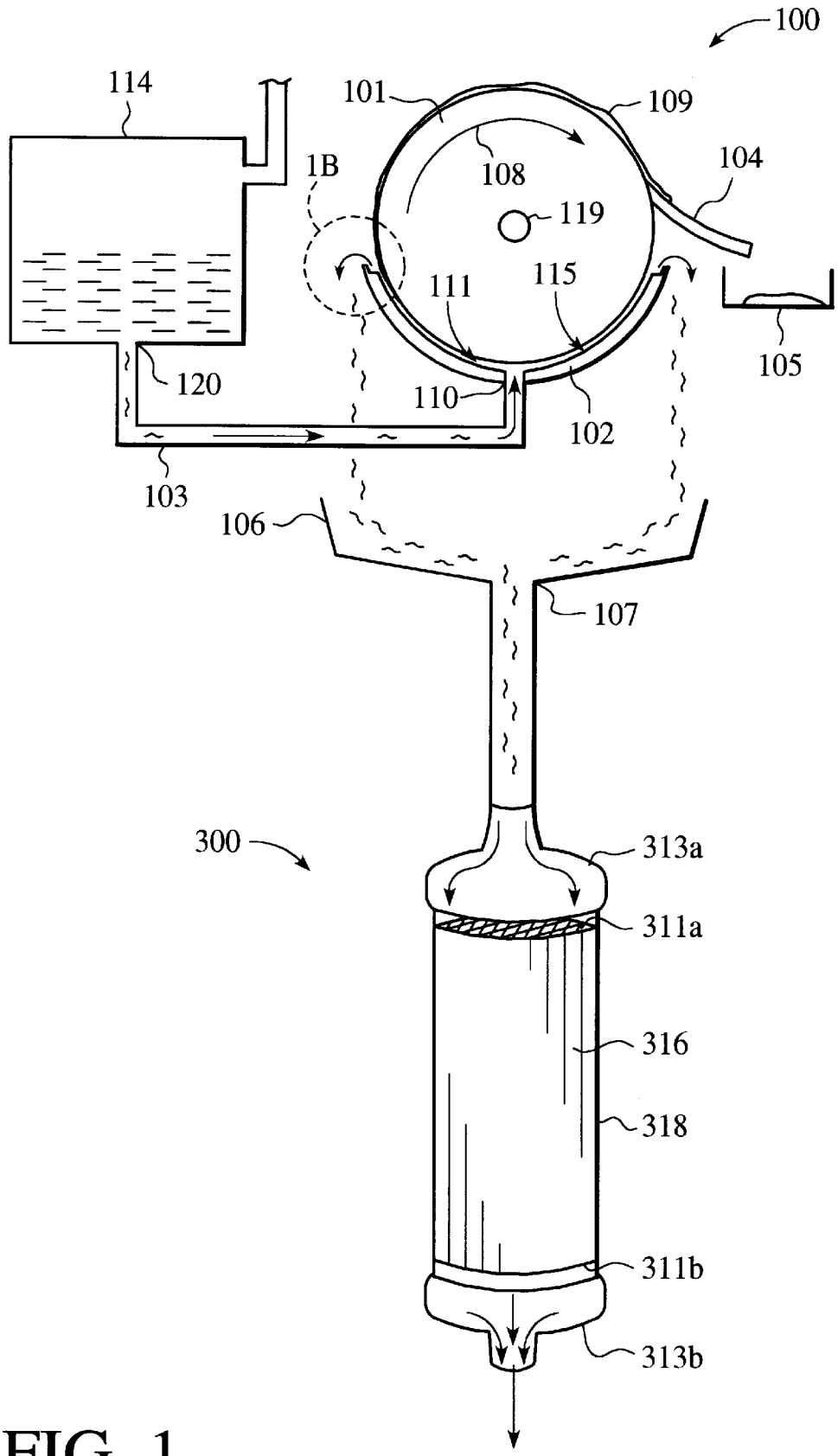
FIG. 1 shows a plan view of a purification system with sequential electrophoretic and particulate filter purifiers, used in the method of the present invention.

With reference to FIG. 1, a drum purifier 100 and a particulate, i.e. non-membranous, filter purifier 300 are shown, connected in series. A liquid containing contaminants is first passed through drum purifier 100 wherein contaminants, primarily charged solids such as color pigment particles and paper debris, are removed. Then, the liquid is passed through filter purifier 300 and any remaining contaminants are removed.

Liquids to be purified enter drum purifier 100 through opening 110 of repelling electrode 115 in the preferred embodiment. Repelling electrode 115 is shaped as a cylindrical trough and borders an approximately 120° arcuate portion of rotating drum 101. The liquid generally occupies the narrow gap 111 between repelling electrode 115 and rotating drum 101. Repelling electrode 115 is biased to repel particles within the liquid which possess a like electric charge, such as toner particles. Debris particles from the imaging paper used in electrostatic printing and other contaminants tend to acquire a charge of the same polarity as the toner particles. Both toner and debris particles move through the liquid and adhere to the surface of rotating drum 101.

Figure 2:
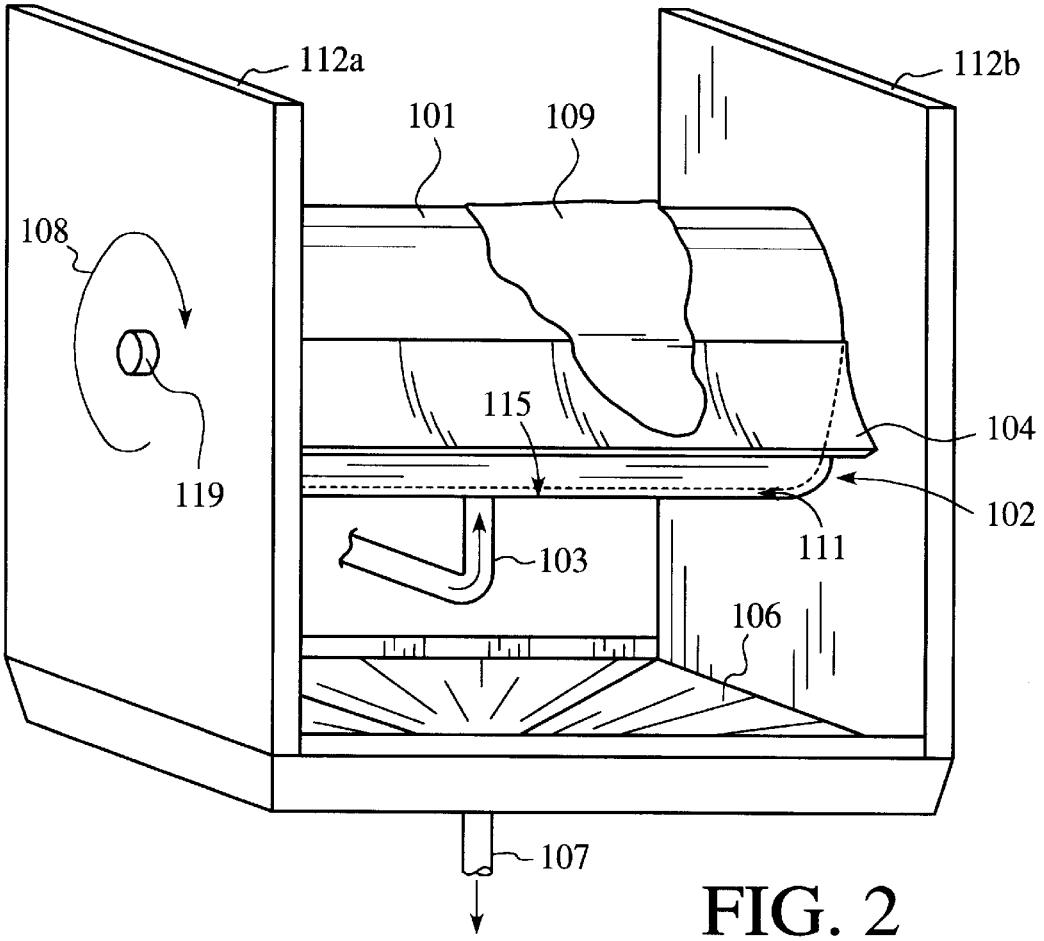
FIG. 2 shows a perspective view of the drum purifier used in the present invention.

Drum 101, an end view of which is illustrated in FIG. 1 with its side plates removed, rotates about axle 119 and carries the contaminants which have adhered to drum 101 in a slurry 109 out of the liquid. Drum 101 preferably has its axis in a horizontal position and the direction of rotation 108 is preferably toward a scraper blade 104 which has an edge along rotating drum 101. Scraper blade 104 scrapes slurry 109 from the drum surface. Scraper blade 104 may be a thin steel blade or, preferably, a urethane blade of the type widely used for scraping dry powder from drums in xerographic printers and copiers. The scraper blade 104 is preferably of a length approximately the width of the drum's cylindrical surface, as seen in FIG. 2. The surface of rotating drum 101 is thus cleaned and ready for further plating out of contaminants on a subsequent pass across gap 111. The slurry 109 that has been scraped off may be collected, as in waste tray 105 of FIG. 1, for removal from the system. The remaining portion of the liquid, which is allowed to spill over the top edges of the trough is now substantially free of solid contaminants, and in the case of liquid toner, is substantially color free. The flow rate of liquid into opening 110 may be adjusted so that the contaminants are plated out before the fluid reaches the lateral edges of drum 101. The liquid which is introduced into gap 111, after partial purification, spills into a catch funnel 106 which underlies repelling electrode 115. Funnel 106 preferably has sloped sides and a central opening 107, which allows for drainage of the partially-purified liquid from drum purifier 100.

Drum purifier 100 is shown in a perspective view in FIG. 2. Reference numbers have been applied to parts previously described. Side plates 112*a–b* connect to and position the various components relative to each other. Axle 119 is connected to a gear motor, not shown, for rotation of the drum. Rotating drum 101 is preferably four inches in diameter and four inches in length, for the purpose of continuous purification of liquid toner for electrostatic printers, but may be varied for other applications. Repelling electrode 115 covers approximately 120° of the bottom of rotating drum 101 and is shaped as a cylindrical trough with its end edges at the same height as its lateral edges. Alternatively, repelling electrode 115 may be housed within the interior surface of a trough 102 or other means of containing liquid and keeping electrode 115 in close proximity with drum 101.

Figure 1B:
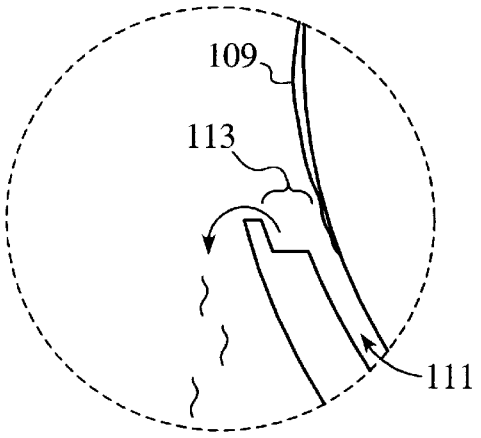
FIG. 1B is an enlarged view of a portion of FIG. 1 showing details of the drum purifier used in the present invention.

The gap 111 between repelling electrode 115 and drum 101, shown in FIGS. 1 and 2, is approximately 0.020 inch in width. The applied voltage is approximately 2000 volts corresponding to a field of about 100,000 volts per inch. Different combinations of gap width and voltage may be used but this combination is practical from the standpoint of flow capability. Wider gaps require higher voltage and are more prone to electrical breakdown. Narrower gaps can restrict the liquid flow too much. Generally, the gap should be in the range 0.015 to 0.025 inches and the applied voltage in the range of 1000 to 3000 volts, but other combinations may be practical depending on the size of drum 101 to be used and the characteristics of the liquid to be purified. As shown in FIG. 1B, which is an enlargement of a portion of FIG. 1, gap 111 widens 113 to approximately 0.060 inches at the top edges of repelling electrode 115 in order to prevent electrical edge breakdown. This may occur across the liquid meniscus which bridges the gap between the top edge of trough 102 and the rotating drum 101. For the purpose of liquid toner purification, in the example below, drum 101 was electrically grounded and a voltage of approximately 2000 volts was applied to repelling electrode 115.

In the case of liquid toner, isopar G, a volatile petroleum product available from Exxon Corp., often serves as the clear fluid dispersant for color concentrate particles. The drum purifier operates at a rotational rate of approximately two rpm, which is slow enough to allow any dispersant carried out of trough 102 with the solid contaminants to drain back into trough 102, resulting in a viscous slurry 109. Slurry 109 moves slowly down scraper blade 104 and generally has time to dry by evaporation. Thus, the drum purifier waste dries up into chunks which easily break off and fall into waste tray 105 of FIG. 1. Waste tray 105 is removable for periodic emptying. Input supply conduit 103 of FIG. 1 is connected to a holding tank 114 which is at approximately the same level as drum purifier 100. The top of trough 102 is positioned somewhat above the outlet 120 of holding tank 114 so that holding tank 114 never empties completely into trough 102. This insures that trough 102 remains filled to the top with liquid and that gap 111 is always filled with insulating liquid rather than with air, which can break down electrically.

In the method of the present invention, the partially-purified liquid emerging from drum purifier 100 leaves funnel 106, as shown in FIG. 1, and travels through a conduit to filter purifier 300. Filter purifier 300 removes molecules that are neutral or that have ionized since leaving drum purifier 100. Filter purifier 300 contains a packed bed of a material 316 of FIG. 1 that is particulate or granular, and through which liquid can pass. The porous material 316 is preferably activated charcoal, available from American Norit Corp., which is economical and effective at removing a large number of chemical species from liquids. Other appropriate porous materials include diatomaceous earth and zeolite, which is available from Union Carbide Co. Similar materials which have a large surface area and which remove contaminants from a liquid via absorption, adsorption, or chemical binding may be substituted. "Contaminant-retentive" as used here signifies retention via absorption, adsorption, or chemical binding. The grains that make up the porous material 316 are preferably in the range of 0.001 to 0.1 cm. Smaller grains tend to impede liquid flow through the purifier. Larger grains do not provide good exposure of all portions of the liquid to the surfaces of the grains within porous material 316.

Figure 3:
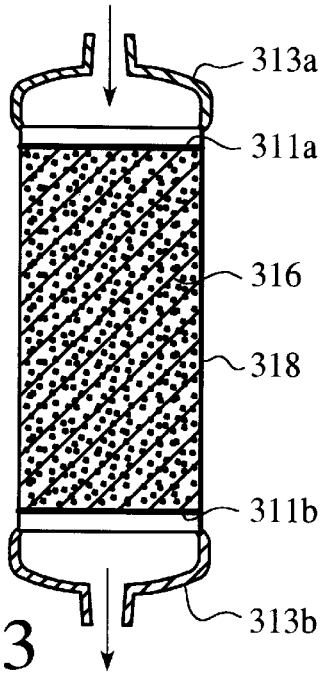
FIG. 3 shows a cross-sectional view of a preferred embodiment of the porous material and cylindrical housing of the particulate filter purifier.

FIG. 1 shows porous material 316 confined within a housing 318 for ease of use. Porous material 316 need not completely fill housing 318. End caps 313*a* and *b* are attached to housing 318 and contain openings for liquid inlet and outlet, respectively. Preferably, housing 318 also contains screens 311*a* and *b,* which are perforated to allow passage of liquid, but not of porous material 316. Screen 311*a* is positioned against porous material 316 at the liquid inlet side of filter purifier 300 and screen 311*b* is positioned against porous material 316 at the liquid outlet side of filter purifier 300. FIG. 3 shows filter purifier 300 in cross-section, with the appropriate reference numbers for parts previously described. The liquid emerging from end cap 313*b* is in a highly purified, insulating, stable form. The liquid may then be reused, e.g. as fresh fluid dispersant to which color concentrate particles may be added, for the creation of liquid toner.

For liquid toner purification, filter purifier 300 is preferably approximately four inches in axial length and four inches in diameter. These dimensions and shapes may be adjusted as appropriate for the application. The porous material 316 also serves to counteract possible discoloration of the liquid due to oxidation, in the liquid toner application. Oxidation, if excessive, can affect the imaging properties of the liquid toner. Oxidation of liquid toner can also be inhibited by chemical anti-oxidants, as is well known in the liquid toner formulations art.

The purification method of the present invention is of particular utility in situations where the liquid to be purified contains charged particles, as well as neutral molecules that either ionize slowly or not at all. Use of drum purifier 100 to remove color pigment particles and other charged particles, followed by filter purifier 300 to remove further neutral and ionic contaminants, results in a clear, highly purified liquid that is virtually free of charged particles and other contaminants and which remains highly insulating in storage. In the liquid toner example, the ionization kinetics of the contaminant molecules are relatively slow. Drum purifier 100 removes existing ionic contaminants from the liquid, but the ionized fraction of contaminant molecules is small. To remove substantially all of the contaminants, purification via drum purifier 100 is followed by a pass through filter purifier 300. Neutral molecules, as well as some previously neutral molecules that have become ionized are thereby removed. If filter purifier 300 were used alone to purify liquids such as liquid toner, it would become clogged with solid debris and need to be replaced on a frequent basis. The configuration of the present invention allows for replacement of filter purifier 300 less often.

In the application of the present invention, liquid toner purification within an electrostatic printing system, the dispersant contained in the printing system passes periodically through the purification system. It is not, in this case, necessary that all of the contaminants be completely removed in any one transit through the system. It is generally only necessary that the concentration of the contaminants, and especially ionizable species, be kept low enough to eliminate the need to replace the toner due to contamination. Even the removal of a relatively small percentage, such as one percent, of the ionizable molecules during one transit through the purification system may be sufficient to control contamination effectively. The percentage removal required per transit depends on application and image quality requirements. Removal of the required minimum percentage will insure that a stable, steady-state condition is achieved in which image quality is consistent and image colors predictable and for which toner replacement is unnecessary. It may be more economical to remove the ionizable species from only a small portion of the liquid toner of an electrostatic printing system, according to the method of the present invention. A small required removal percentage corresponds to small and economical purifiers. This partial removal also has the advantage of minimizing oxidation effects, in this application.

The manner of carrying out the present invention is by incorporating the sequential purification system into a continuous electrostatic printing and toner purification system. An example of this method is depicted in the schematic diagram of FIG. 4.

Figure 4:
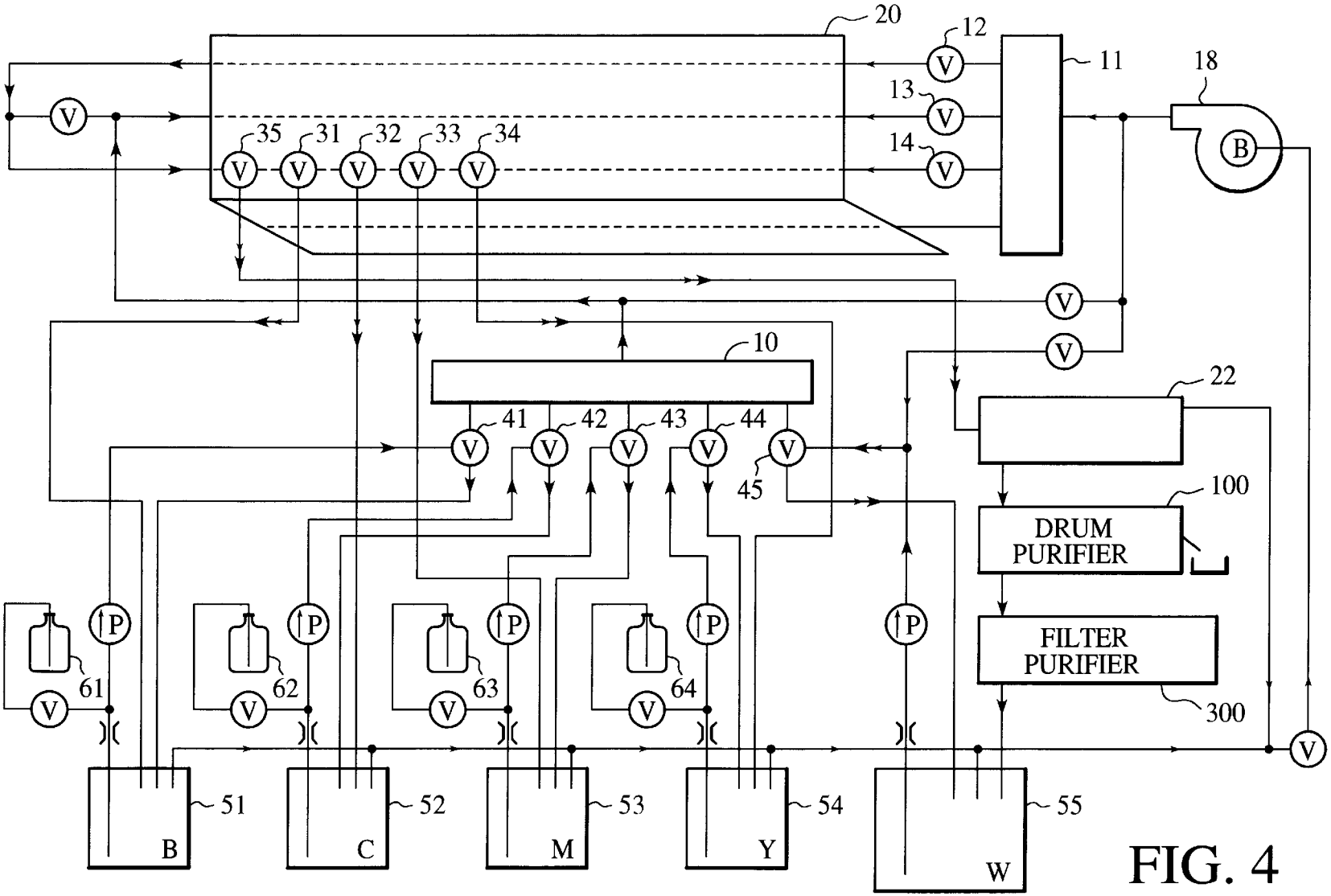
FIG. 4 presents a schematic view of an electrostatic printing system utilizing the purification method of the present invention.

In FIG. 4, large arrows indicate liquid flow and small arrows indicate air flow. The lines that contain both large and small arrows carry both liquid and air. The colors black, cyan, magenta, and yellow are typically used in a four-color printing system and are shown in toner tanks 51–54, respectively. The color toners are continually pumped out of their toner tanks and circulated up to the region of input selector manifold 10. When a particular color is to be used, the valve 41–44 corresponding to the color is opened and the color toner enters input selector manifold 10. From there, it is directed to toning applicator 20 which contacts the paper or other printing surface and which may extend the full width of the web upon which the printing will occur. Tank 55 contains wash fluid, i.e. the same clear fluid dispersant, such as isopar G, that is used to disperse color pigment particles to make the color toners contained in toner tanks 51–54. The wash fluid is circulated and in connection with input selector manifold 10 in the same manner as the color toners.

After a color toner has been applied to paper via toning applicator 20, the liquid remaining within toning applicator 20 is substantially removed by an air purge loop having its source at blower 18. The color toner is drained back into the appropriate toner tank through the operation of the air purge and the appropriate valve 31–34. Approximately five milliliters of color toner is purposely left behind in toning applicator 20. Then toning applicator 20 is washed via a pass of approximately three hundred milliliters of wash fluid which carries away the five milliliters of color toner left behind in toning applicator 20 from the previous color pass. The dirty wash fluid then drains into holding tank 22 before it enters into the purification system of the present invention. The next color toning pass is started by the opening of one of the valves 41–44, flow of the selected color into input selector manifold 10, and input of the color toner into toning applicator 20, as with the previous color pass. Wash fluid passes occur between color passes so that there is no cross-contamination of the different color toners. Generally, four-color printing occurs via separate color passes in a dark to light sequence, so the typical order of liquid usage is as follows: black toner, wash, cyan toner, wash, magenta toner, wash, yellow toner, wash.

The air purge loop within this system is optional, as drainage of toning applicator 20 may be effected by other means, such as gravity flow. The use of an air purge loop through the various lines is preferable, however, as it allows for rapid, controlled removal of color toner from toning applicator 20. The air purge loop includes blower 18, pressure manifold 11, and valves 12–14 for purging of various drain and supply lines. An air jet cleaner is described in commonly assigned U.S. Pat. No. 5,231,455. A mixture of air and dirty wash fluid enters holding tank 22. Liquid is gravitationally drained from holding tank 22 and enters the dual purifier system. The air in holding tank 22 is removed via an outlet at or near the top of holding tank 22, and reenters the air lines and eventually the inlet of blower 18. An internal baffle may help reduce splatter within holding tank 22. In the same manner, the mixture of air and color toner that drains into toner tanks 51–54 is separated by gravity. Air is removed from each toner tank through an outlet at the upper portion of the toner tank and reenters the air lines.

During a color pass, the toning process carries out some of the color pigment particles as visible image. The toner within the electrostatic printing system leaving toning applicator 20 is therefore somewhat diluted in terms of color pigment percentage. Therefore, color concentrate from concentrate bottles 61–64 may replenish the color toner in toner tanks 51–54, as necessary.

After dirty wash fluid has passed through holding tank 22, it first enters drum purifier 100 and then filter purifier 300 to undergo the purification process of the present invention. Purified wash fluid, which is clear, low-conductivity isopar in this example, emerges from the second purifier and reenters wash fluid tank 55 for reuse in the system. The clear dispersant in tank 55 is thereby kept in a high purity, highly insulating condition. Mixing of a portion of the wash fluid into the toners therefore does not degrade the toners.

The electrostatic printing system depicted in FIG. 4 incorporates a continuous purification system. Each color toner pass and subsequent air purge leave approximately five milliliters in toning applicator 20. The washing process carries this five milliliters of color toner and any other paper debris or chemical contaminants received from the contact of toning applicator 20 and the printing surface out of toning applicator 20 and into the two purifiers. The clean wash fluid reenters wash fluid tank 55 and is reused for subsequent washing of toning applicator 20. After washing and air purging of the wash fluid, there remains as much wash fluid in the applicator, 5 to 10 milliliters, as there was toner after toner purging. Normally, each liquid is purged into its respective holding tank. Each toner tank has a level sensor, however, and, if the contents of a toner tank drop below a pre-determined level, the wash fluid may be purged into that tank to control the liquid level. In this way the liquid level in each toner tank is automatically controlled. The user need only resupply clear liquid dispersant to the wash fluid tank. This is a neat and clean process because colored toners are not involved. As needed, fresh bottles of concentrate may be replaced by simply unscrewing the empty bottle and replacing it with a new one. These new concentrate bottles may have neck seals consisting of thin foil. The new bottle is raised towards a mounting receptacle causing a concentrate withdrawal needle to penetrate the foil. The clean plastic cap from the new bottle is used to seal the empty bottle. Thus the replacement of concentrate is also a clean, non-messy process. As the user never has to handle toners themselves, operation of the printer is a clean process and suitable for an "office" environment. The applicator and associated plumbing is self-cleaning since it is washed by the wash fluid.

The amount of contaminants removed from a toner by the purification system during a color pass is proportional to the amount of toner left in the toning applicator after purging with air. By adjusting the time duration of air purging, this amount of residual toner can be controlled. It is believed that contact of the toner with the printing paper during a toning pass introduces a small amount of deleterious contaminants into the toner. Thus a fixed amount of contaminants is likely to be introduced per pass. On the other hand, the amount of contaminants removed per pass is proportional to the contaminant concentration. This means that the contaminant concentration will slowly build up until the amount removed per pass just balances the amount picked up per pass and the limit is approached asymptotically. By adjusting the air purging time, this steady-state contaminant level may be held to any desirable level. With very brief air purging, more toner is left behind to be intermixed with the wash fluid and removed from the system. This results in a lower steady-state contamination level. It also results in a larger amount of solid waste in the tray to be discarded, but the amount of waste is, at most, only a few grams per day. This is insignificant in comparison to the large amount of liquid waste produced in the prior art. The drum purifier lasts indefinitely and does not require replacement. The filter purifier has long life depending on its size and composition, because most large particles have been removed before the liquid enters the filter purifier. The continuous purification system described is similar to that disclosed in commonly assigned U.S. Pat. No. 5,404,210 to Day.

A user of an electrostatic printing system using the method of the present invention need only throw out solid contaminants collected in waste tray 105, replace color concentrate bottles 61–64 because color pigment particles are used for the images printed and a small amount is lost through the purification system, and add wash fluid which is steadily lost to the printed paper and to some evaporation within the system. All of these tasks need only be performed on an occasional basis. In one week of operation of an electrostatic printer having the tandem purification system, at a rate of eighty large color prints per day, about two ounces of solid contaminants are collected and need to be discarded. The amount of waste and ease of removal of that waste represent a significant advancement over previous methods. The requirement of removing and disposing of large volumes of spent toner has been eliminated.

We claim:

1. A method of continuous purification of liquid toner in an electrostatic printing system, comprising, circulating a first volume of liquid toner from a toner supply tank through a common volume, the common volume including an applicator where solid and ionic contaminants are introduced into the first volume, prior to circulation back to the toner supply tank for each toning pass, leaving some contaminants and toner in the common volume as a second volume, circulating wash fluid from a wash fluid supply tank through the common volume after each toning pass, removing the second volume within a third volume consisting of wash fluid mixed with the second volume, passing the third volume through an electrophoretic purifier to remove the contaminants therefrom, then passing the third volume through a porous particulate filter to remove any remaining contaminants therefrom, and returning the third volume to the wash fluid supply tank.

2. A method of continuous purification of liquid toner, as in claim 1, further comprising, circulating the first volume back to the toner supply tank for each toning pass by means of an air purge loop.

3. A method of continuous purification of liquid toner, as in claim 2, further comprising, adjusting the air purging time during the circulation of the first volume back to the toner supply tank to control the concentration of contaminants in the second volume.

4. A method of continuous purification of liquid toner, as in claim 1, further comprising, repeating all of the steps for each of a number of different colors of liquid toner.

5. A method of continuous purification of liquid toner, as in claim 1, further comprising, repeating all of the steps for liquid toner of a second color, then a third color and then a fourth color.

6. A method of continuous purification of liquid toner in an electrostatic printing system, comprising, circulating a first volume of liquid toner from a toner supply tank through a common volume, the common volume including a toning applicator, the toning applicator introducing solid and ionic contaminants into the first volume, circulating the first volume back to the toner supply tank after each toning pass by means of an air purge loop, some contaminants and toner being left in the common volume as a second volume, circulating wash fluid from a wash fluid supply tank through the common volume after each toning pass, removing the second volume within a third volume consisting of wash fluid mixed with the second volume, passing the third volume through an electrophoretic purifier to remove the contaminants therefrom, passing the third volume through a porous particulate filter to remove any remaining contaminants therefrom, and returning the third volume to the wash fluid tank.

7. A method of continuous purification of liquid toner, as in claim 6, further comprising, repeating all of the steps for each of a number of different colors of liquid toners.

* * * * *